United States Patent [19]

Hatakeyama

[11] 4,244,572

[45] Jan. 13, 1981

[54] BOARD GAME HAVING MOVABLE TARGET

[75] Inventor: Korechika Hatakeyama, Tokyo, Japan

[73] Assignee: Tomy Kogyo Co., Inc., Tokyo, Japan

[21] Appl. No.: 40,925

[22] Filed: May 21, 1979

[30] Foreign Application Priority Data

May 19, 1978 [JP] Japan ..... 53-68152[U]

[51] Int. Cl.[3] ..... A63B 65/12; A63D 3/02

[52] U.S. Cl. ..... 273/120 R; 273/119 A; 273/127 C; 273/128 A

[58] Field of Search ..... 273/101, 105.2, 105.5, 273/108, 113, 119 R, 119 A, 127 R, 127 C, 128 A, 129 R, 129 A

[56] References Cited

U.S. PATENT DOCUMENTS

| | | | |
|---|---|---|---|
| 1,542,063 | 6/1925 | Knight | 273/101 |
| 3,358,997 | 12/1967 | Belz | 273/89 |
| 3,498,615 | 3/1970 | Toutoundjis | 273/120 |
| 3,588,110 | 6/1971 | Hirach | 273/119 |
| 3,643,951 | 2/1972 | Breslow | 273/108 |
| 3,649,019 | 3/1972 | Barlow | 273/101 |
| 4,037,840 | 7/1977 | Goldfarb et al. | 273/85 A |

*Primary Examiner*—Robert L. Lindsay, Jr.
*Attorney, Agent, or Firm*—K. H. Boswell; Edward D. O'Brian

[57] ABSTRACT

A board game is constructed having a playing surface and an object release mechanism coordinating with the playing surface such that an object released from the release mechanism is deposited onto the playing surface. A target mechanism having an object holder located thereon moves along the playing surface. The target mechanism is driven to move in a timed sequence on the playing surface and if the object is released from the object release mechanism in coordination with movement of the target, the object will be retained on the object holder. If, however, the release of the object from the object release mechanism is not coordinated with the movement of the target, the object will miss the target and be deposited in a receptacle in the playing surface. The game is played with a plurality of objects and skill is measured by correctly depositing as many of these objects as possible in the object holder as opposed to the receptacle.

12 Claims, 4 Drawing Figures

BOARD GAME HAVING MOVABLE TARGET

BACKGROUND OF THE INVENTION

This invention relates to a game having a playing surface and a target which is movable on the playing surface. The objective of the game is to correctly locate an object on the movable target.

There are many games of the "pinball type" wherein it is the object of the game to propel a pinball across a surface and deposit this pinball in a specific hole or other orifice in that surface. Generally these games are mounted in large housings which typically are waist-high and occupy considerable floor space. The popularity of these games attest to their acceptance and recreational values.

Certain toys have mimicked these pinball machines and in essence are small scale pinball games. As with the large pinball games the holes or other orifices in the playing surfaces are fixed in a stationary position, and skill in depositing a pinball or other object in these holes or other orifices is dependent upon manipulating mechanical components of the pinball machine. As for example, the velocity imparted to the pinball is governed by the amount of force imparted to the pinball which in turn is governed by the distance the shooting plunger is pulled back against the bias of the spring associated with it. Missing from this type of game is any type of requirement requiring the player to coordinate the timing between movement of the pinball and the target.

There are other types of games such as target shooting games wherein a target is moving and a player shoots a projectile at the target. This type of game does require coordination between the player and the timing of the movement of the target. However, in this type of game the projectile is usually moving at a very rapid velocity and is not easily observable by the player. Further, because of the velocity of the projectile there is an inherent danger of this type of game in the hands of a small child.

In view of the above it is considered that there exists a need for a new type of game which incorporates the amusement value of a pinball-type game and the timing coordination value of a target-type game.

BRIEF SUMMARY OF THE INVENTION

It is an object of this invention to provide a game which incorporates the above noted amusement value of a pinball-type game with the above noted coordination value of a target-type game. It is a further object that such an integrated game be easily manufactured and thus within the economic reaches of a large segment of the consuming public.

In view of these and other objects which will become apparent by the remainder of this specification and from the drawings attached hereto, there is provided in a board game of the type having a playing surface and an object release means associated with the playing surface which will release an object to move across the playing surface toward a target means the improvement which includes said game having a movable target means located so as to move relative to said playing surface and including on that target means an object holding means for holding an object released by the object release means. Also associated with the playing surface is a receptacle means which is also capable of holding or receiving said object released by said object release means. The target member is moved in a patterned sequence and if said object is released from said object release means in coordination with the movement of said target, said target is capable of holding or capturing said object. If said object is released by said object release means in a manner not in coordination with the movement of said object said object is not held or captured by said target means and said object is deposited in said receptacle means.

In a preferred embodiment of the invention the target means will include a target member having said object holding means mounted thereon and moving in a reciprocal manner such that said object holding means will reciprocate back and forth through an arc and will include at least one position in said arc wherein if said object is released from said object release means at the proper time in respect to movement of said target, said object will be captured by said object holding means. Additionally said object holding means is mounted on said target member such that it moves within said receptacle. If said object is not released at the proper time, said object will not be captured by said object holding means and will be deposited in said receptacle. Normally, the object will constitute a round ball which will roll on the playing surface. The target means will include a target drive means which drives the target member back and forth in a reciprocal manner and the drive means can be constructed so as to include a timing means such that the target member moves at a first velocity in one direction and at a second velocity in the opposite direction.

BRIEF DESCRIPTION OF THE DRAWING

This invention will be better understood when taken in conjunction with the drawing wherein.

Figure 1:
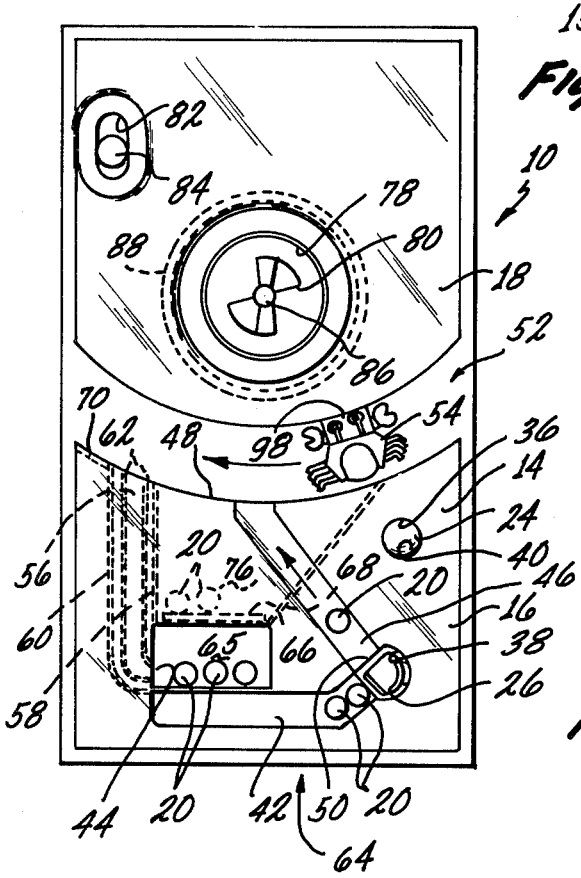
FIG. 1 shows a plan view of the invention showing certain underlying components in phantom.
Figure 2:
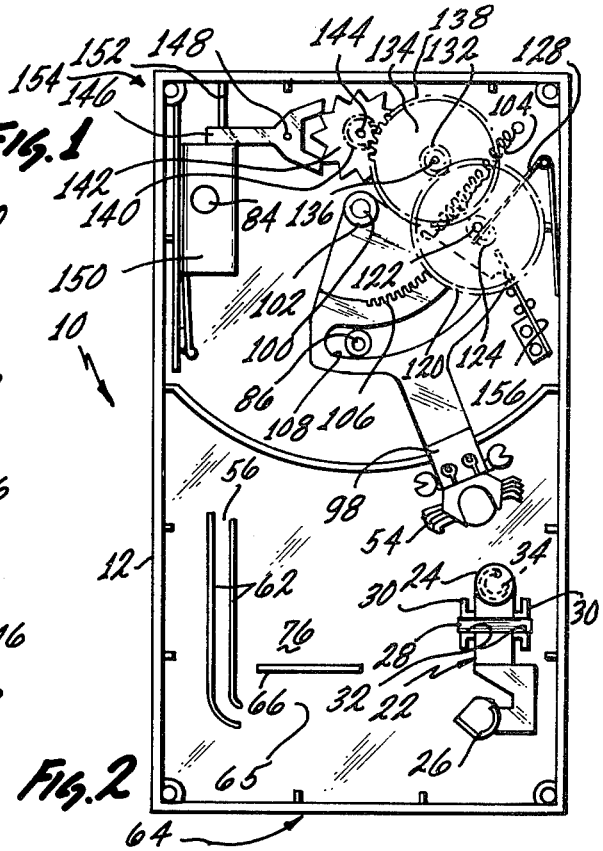
FIG. 2 is a plan view of the invention wherein the playing surfaces are removed to expose working components located underneath said playing surfaces.
Figure 3:
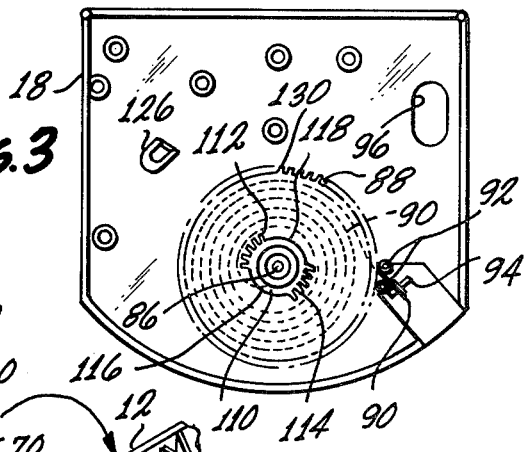
FIG. 3 is a bottom plan view of the upper playing surface found in the top portion of FIG. 1.

The invention shown in the drawing and described in the specification utilizes certain principles and concepts which are claimed in the claims appended to this specification. Those skilled in the art to which this invention pertains will realize that these principles and concepts can be applied to a number of differently appearing embodiments without departing from the spirit and scope of the claims of this invention. For this reason this invention is to be construed in light of the claims and is not to be construed as being limited to the exact embodiments illustrated in the drawing and the specification.

DETAILED DESCRIPTION

The game 10 includes a lower housing 12 having an upper transparent housing 14 located thereon. After the game 10 is assembled the upper housing 14 is affixed to the lower housing 12 by solvent welding or other standard fastening methods maintaining the two housings together. Fitting inside lower housing 12 is a lower playing surface member 16 and an upper playing surface member 18. Located between the lower and upper playing surfaces 16 and 18 and the lower housing 12 are certain movable parts as hereinafter numbered and described.

Contained within the upper and lower housings 14 and 12 are a plurality of metal balls or objects 20 which at times can be found on top of the lower playing surface 16 and at other times are located between lower housing 12 and lower playing surface 16. Located underneath lower playing surface 16 is ball release lever 22. Ball release lever 22 has two projections—ball button 24 and ball raiser arm 26—located on the respective ends of the lever 22. The lever 22 has a central axle 28 which is appropriately journaled in two projections both identified by the numeral 30 which project from the lower housing 12 and include bearing surfaces 32 in which axle 28 is mounted. The inside of ball button 24 is hollow and a compression spring 34 is located therein and pushes down against the lower housing 12. This biases lever 22 in a manner wherein ball button 24 is pushed upwardly through slot 36 in lower playing surface 16. The ball raiser 26 on the other end of the lever 22 is depressed within a slot 38 in lower playing surface 16. A slot 40 in upper housing 14 placed directly over slot 36 allows ball button 24 to project through the upper housing 14 and be accessible to manipulation by a finger of the player using the game 10.

An inclined chute 42 formed in the surface of lower playing surface 16 slopes downward toward slot 38. To begin playing the game, the player inverts the game 10, shaking all of the metal balls 20 either from the top of lower playing surface 16 or through cutout 44 in the lower playing surface 16 until all the balls 20 are located in the inclined chute 42. All of the balls 20 will roll in inclined chute 42 and the first one will be located on the surface of ball raiser 26 within slot 38 and the remainder will be located in inclined chute 42 behind it. The inclined chute 42 slopes toward the ball raiser 26 so that when the first ball 20 located on the surface (not separately numbered) of ball raiser 26 is discharged from the surface as hereinafter described the next ball 20 in line will roll down the inclined chute 42 and come to rest on the surface of ball raiser 26.

A second inclined chute 46 hereinafter referred to as the release chute 46 slopes away from the ball raiser 26 toward the edge 48 of lower playing surface 16. The highest part of release chute 46 is nearest ball raiser 26. The lowest part of release chute 46 is at the edge 48. When ball button 24 is depressed lever 22 pivots and the ball resting on ball raiser 26 is raised in an upward direction. When this ball is raised sufficiently so that it clears edge 50 on release chute 46 the ball 20 on ball raiser 26 rolls down release chute 46 toward edge 48 of lower playing surface 16.

Between lower playing surface 16 and upper playing surface 18 is an arcuate shaped receptacle 52. This receptacle 52 forms a break between the upper and lower playing surfaces 18 and 16. Traveling within receptacle 52 as hereinafter described is a ball holder 54 which is shown in the shape of a small crab in the embodiment illustrated in the drawing. The ball holder 54 travels in a back-and-forth manner as hereinafter described within receptacle 52. When the ball holder 54 is in the position as shown in FIG. 1 a ball 20 coming down release chute 46 will be deposited in the ball holder 54. If the ball holder 54 is not in the position as shown in FIG. 1 when the ball 20 comes down the release chute 46 it will fall over the edge 48 into the receptacle 52.

The ball holder 54 travels through the receptacle 52 from right to left at one velocity. It then returns from left to right at a second velocity. The velocity from right to left is preferably slow enough that the player in playing the game will be able to time the release of a ball 20 down release chute 46 such that the ball 20 reaches the edge 48 at the same time that the ball holder 54 moves into position opposite at the end of release chute 46 to capture the ball 20. Once captured the ball holder 54 continues on its arc toward the left side of the game 10 and deposits the ball in a point chute 56. On the return trip from left to right the velocity of a ball holder 54 is preferably greater than its velocity going from right to left. This rapidly brings the ball holder 54 back to the right-hand side of the receptacle 52 and in position to make another swing opposite the end of release chute 46 giving the player of the game 10 a chance to deposit a second ball 20 on the ball holder 54.

Figure 4:
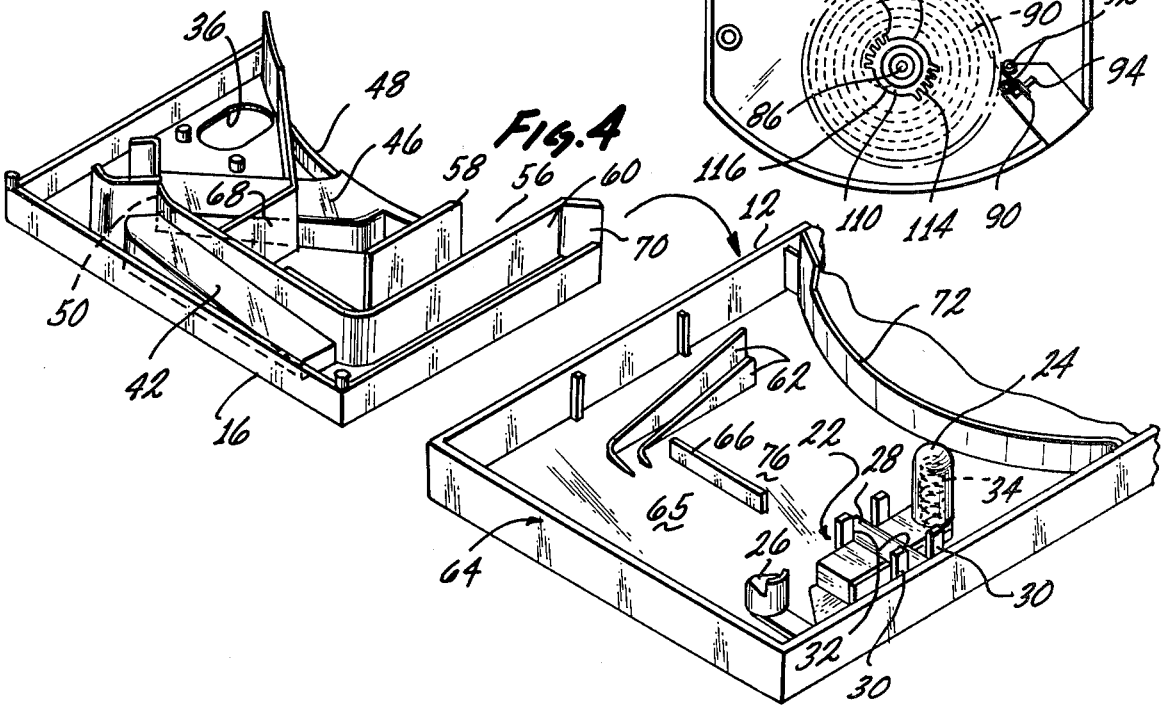
FIG. 4 is a prospective view of the bottom side of the lower playing surface shown in the bottom portion of FIG. 1 and the bottom portion of the game on which it fits.

On the underneath side of lower playing surface 16 as seen in FIG. 4 are a series of baffles. Baffles 58 and 60 form the sides of point chute 56. Projecting from the surface (not separately numbered) of lower housing 12 and fitting in between baffles 58 and 60 are two wedge-like projections commonly numbered by numeral 62 which slope downward away from receptacle 52. When a ball 20 is deposited by ball holder 54 in point chute 56 the ball 20 is deposited on the top of wedge-like projections 62. This causes the ball 20 to roll toward end 64 of game 10 and to come to rest in area 65 beneath cutout 44. The balls 20 are maintained in area 65 by a rib 66 projecting upwardly from lower housing 12. Baffle 60 curves around and a portion of it lies parallel to rib 66 while a portion of another baffle 68 meets perpendicularly to the parallel portion of baffle 60. The positions of baffles 60 and 68 in conjunction with rib 66 form three side walls (not separately numbered) for area 65 which is exposed to view by cutout 44. This maintains all the balls 20 which go down point chute 56 visible through cutout 44.

If when a ball 20 goes down release chute 46 and is not correctly deposited into ball holder 54, the ball 20 drops into receptacle 52. Baffle 68 courses underneath release chute 46 until it meets with and forms part of the edge 48. A small baffle 70 extends from baffle 60 to the left-hand side of lower playing surface 16. An arcuate shaped baffle 72 is co-arcuate to edge 48, and projects from lower housing 12 forming the other side of receptacle 52. When a ball 20 is discharged into receptacle 52 it is directed by baffles 68, 70 and 72 into an area 76 beneath lower playing surface 16. Normally lower playing surface 16 is made of a solid material and once any of the balls 20 are deposited into receptacle 52 they are no longer visible to the player through the upper housing 14. Because wedge-like projections 62 slope downward toward end 64 they form an obstacle on the surface of lower housing 12 and any balls 20 deposited into receptacle 52 cannot roll into point chute 56. Further, any ball 20 within area 76 is prevented from entering the area 65 by rib 66. The combination of the baffles and the rib serve to separate the balls which are misplaced in the receptacle 52 from those which are correctly placed into ball holder 54.

Exposed through a cutout 78 in upper housing 14 is wind-up knob 80. Exposed through cutout 82 in upper housing 14 is off-on knob or button 84. These are both exposed to manipulation by a player's fingers. Wind-up knob 80 is located on the surface of upper playing surface 18 and is mounted on an axle 86 extending through upper playing surface 18. Attaching to axle 86 and spaced slightly away from the bottom side of upper playing surface 18 is a compound gear 88. Attaching to axle 86 and interspaced between compound gear 88 and upper playing surface 18 is spring 90. The other end of spring 90 is appropriately fixedly held between two tabs commonly identified by the numeral 92 in conjunction with a locking pin 94. A slot 96 allows a passageway for off-on knob 84 through upper playing surface 18.

A target arm 98 is located between lower housing 12 and the bottom side of upper playing surface 18. Ball holder 54 is integrally formed on one end of target arm 98. On the other end of target arm 98 is a boss 102 which fits onto an upstanding pin 100 projecting from lower housing 12. This allows target arm 98 and consequently ball holder 54 to pivot in an arc about pin 100. A portion of the target arm 98 proximal to the ball holder 54 rests against and slides along the top surface of baffle 72. This supports ball holder 54 in its proper position within receptacle 52.

A small spring 104 attaches to the right side of target arm 98 and biases target arm 98 and ball holder 54 toward the right side of game 10. A gear rack 106 having an arcuate shape centered at pin 100 is formed on the upper surface of target arm 98. An arcuate cutout 108 also centered about pin 100 forms an opening through target arm 98. When upper playing surface 18 is located on the lower housing 12 axle 86 fits within cutout 108.

Compound gear 88 has an inner gear 110 which contains two arcuate sections of gear teeth 112 and 114 separated by arcuate sections 116 and 118 on which there are no gear teeth. Gear teeth 112 and 114 are capable of intermeshing with gear rack 106; however, as compound gear 88 turns the arcuate sections 116 and 118 are also turned toward gear rack 106 disrupting the intermeshing of gear 110 with gear rack 106 and any motion from compound gear 88 to target arm 98 is broken. Wind-up knob 80 is wound in a clockwise manner and is therefore biased by spring 90 in a counterclockwise manner. When allowed to freely turn compound gear 88 will thus turn counterclockwise.

As compound gear 88 turns the sections of gear teeth 112 or 114 will alternately interact with gear rack 106. Through approximately one-quarter turn of compound gear 88 one of the sections of gear teeth 112 or 114 will cause the rotary motion of compound gear 88 to be transferred to target arm 98 resulting in target arm 98 rotating in a clockwise direction about pin 100. After this approximate one-quarter turn of compound gear 88 one or the other of arcuate sections 116 or 118 are turned into the pathway of gear rack 106. As soon as the sections of gear teeth 112 or 114 completely come free of gear rack 106 spring 104 is free to pull target arm 98 back to the right. Since gear rack 106 is no longer in communication with the sections of gear teeth 112 or 114, gear rack 106 moves through the area of arcuate section 116 or 118 until target arm 98 is completely pulled to the right-hand side of the game 10. As compound gear 88 continues to rotate the other of the gear teeth section 112 or 114 now comes in contact with gear rack 106 and again target arm 98 is rotated in a clockwise direction, i.e., toward the left-hand side of the game 10. This motion is repeated as the compound gear 88 continues to rotate. Thus, for every full rotation of compound gear 88 the target arm 98 and the ball holder 54 attached thereto make two complete swings from the right-hand side of game 10 to the left-hand side of game 10 and back again.

The speed of rotation of compound gear 88 and consequently the speed of the movement of target arm 98 is governed by a timing mechanism (not separately numbered) consisting of two gears and an escape mechanism. Further, the off-on knob 84 interacts with the escape mechanism to fully stop compound gear 88 and thus the target arm 98. The first of the gears of the timing mechanism—spur gear 120—is located on an axle 122 which fits into an elongated boss 124 in lower housing 12 and an identical elongated boss 126 on upper playing surface 18. A small spring 128 biases axle 122 toward one end of elongated bosses 126 and 128. This causes the gear teeth on spur gear 120 to mesh with a set of spur teeth 130 on compound gear 88 as well as a set of pinion teeth 132 on compound gear 134. Compound gear 134 is mounted about axle 136 which fits into appropriate bosses (not separately numbered) on lower housing 12 and on the bottom side of upper playing surface 18.

A set of spur teeth 138 form the other portion of compound gear 134 and are intermeshed with a set of pinion teeth 140 on escapement gear 142. Escapement gear 142 is mounted about axle 144 appropriately mounted in bosses (not separately numbered or identified) located on lower housing 12 and the bottom side of upper playing surface 18. An escapement lever 146 mounted about an axle 148 also appropriately mounted in bosses (not separately numbered or identified) interacts with escapement gear 142. The interaction of the escapement lever 146 with the escapement gear 142 ultimately governs the rotation speed of compound gear 88.

Off-on knob 84 projects from a slide member 150 which slides between a rib 152 and the left side of lower housing 12. When slide member 150 is slid toward end 154 of the game 10 it interacts and locks escapement lever 146. This prevents compound gear 88 from rotating. When the slide member 150 is slid toward end 64 escapement lever 146 is free to move and thus compound gear 88 is free to rotate and transfer its motion to target arm 98.

In playing the game 10 the player first pushes the off-on knob 84 to the "off" position which locks the escape mechanism. Compound gear 88 is rotated clockwise by wind-up knob 80 to bias spring 90. However, since the escapement mechanism is locked compound gear 134 is also locked. The clockwise rotation of compound gear 88 causes spur gear 130 to be moved within the elongated bosses 124 and 126 against the bias of spring 128 until the teeth on spur gear 130 are freed from pinion 132. This allows free rotation of compound gear 88 in a clockwise direction. When clockwise turning of compound gear 88 via wind-up knob 80 is finished the bias of spring 90 causes compound gear 88 to want to rotate in a counterclockwise direction. This motion is transferred to spur gear 130 causing it to move in the other direction in elongated bosses 124 and 126 until it is again locked against pinion 132. This holds the spring 90 in its wound-up position until the off-on knob 84 is slid to the "on" position which frees escapement lever 146 from slide 150.

When the off-on knob 84 is pushed into the "on" position target arm 98 and consequently ball holder 54 starts reciprocating back and forth between the left and right-hand sides of the game 10. The movement is slow from the right-hand side toward the left-hand side when the gear rack 106 is interacting with gear teeth 112 or 114 and is fast from the left-hand side to the right-hand side when the gear rack 106 is free to swing through arcuate sections 116 and 118. The player then depresses ball button 24 to launch a ball 20 down release chute 46 in an attempt to catch the ball on ball holder 54 as ball holder 54 moves from right to left as hereinbefore described. After all the balls 20 have either been successfully placed on ball holder 54 and transferred via point chute 56 to area 65 or have been unsuccessfully lost into receptacle 52 the game is over. Further, if the player waits too long in between launching individual balls down the release chute 46 spring 90 will completely unwind and the ball holder 54 will no longer move back and forth. This also terminates the game. The object of the game is to successfully transfer as many balls as possible to the ball holder 54 and subsequently to the area exposed by cutout 44.

A bumper spring 156 serves to absorb the recoil of target arm 98 as it is pulled to the right side of the game 10 by spring 104.

I claim:

1. In a board game having a playing surface, an object release means for releasing an object so that said object moves across said playing surface, and a target means for receiving an object released by said object release means, said target means being located in association with said playing surface, the improvement which comprises:

said target means including a movable target member located so as to move relative to said playing surface during the use of said game, said target member including object holding means for holding an object released by said object release means;

a receptacle means located in association with said playing surface and capable of receiving said object, said object being capable of being released by said object release means as said target member moves in a time sequence and said object being capable of being held by said object holding means if said release of said object from said object release means is coordinated with the movement of said target means and said object being capable of being deposited in said receptacle means if said release of said object from said object release means is not coordinated with the movement of said target means.

2. The game of claim 1 wherein:

said target member is reciprocally movable back and forth such that said object holding means moves reciprocally between a first position and a second position and including at least one intermediate position wherein said object is capable of being held by said object holding means.

3. The game of claim 2 wherein:

said target means includes target drive means moving said target member in said reciprocal manner.

4. The game of claim 3 wherein:

said object holding means is movably located within said receptacle means and moves reciprocally back and forth within said receptacle means.

5. The game of claim 4 wherein:

said movable target member moves at a first velocity from said first position to said second position and at a second velocity from said second position back to said first position.

6. The game of claim 5 wherein:

said object release means includes at least one object pathway in said playing surface and an object release member;

said object pathway including an opening into said receptacle means and operatively associated with said object holding means when said object holding means is in said intermediate position.

7. The game of claim 6 wherein:

said object is a ball.

8. The game of claim 7 wherein:

said pathway comprises an inclined chute in said playing surface and said object release member being operatively associated with said inclined chute such that said release member releases a ball into said inclined chute and said ball descends said inclined chute toward said opening.

9. The game of claim 5 wherein:

said target drive means includes timer means timing said movement of said target member to govern said first and said second velocity.

10. The game of claim 1 wherein:

said target member is reciprocally movable back and forth such that said object holding means moves reciprocally between a first position and a second position and including at least one intermediate position wherein said object is capable of being held by said object holding means;

said target means includes target drive means moving said target member in said reciprocal manner;

said object holding means is movably located within said receptacle means and moves reciprocally back and forth within said receptacle means;

said object release means includes at least one object pathway in said playing surface and an object release member;

said object pathway including an opening into said receptacle means and operatively associated with said object holding means when said object holding means is in said intermediate position.

11. The game of claim 10 wherein:

said object is a ball;

said pathway comprises an inclined chute in said playing surface and said object release member being operatively associated with said inclined chute such that said release member releases a ball into said inclined chute and said ball descends said inclined chute toward said opening.

12. The game of claim 11 wherein:

said movable target member moves at a first velocity from said first position to said second position and at a second velocity from said second position back to said first position.

* * * * *